US007762484B2

(12) United States Patent
Johnson et al.

(10) Patent No.: US 7,762,484 B2
(45) Date of Patent: Jul. 27, 2010

(54) BLOWING WOOL MACHINE FLOW CONTROL

(75) Inventors: Michael W. Johnson, Lithopolis, OH (US); Michael E. Evans, Granville, OH (US); Todd M. Jenkins, Newark, OH (US); Christopher M. Relyea, Columbus, OH (US)

(73) Assignee: Owens Corning Intellectual Capital, LLCDE (US)

( * ) Notice: Subject to any disclaimer, the term of this patent is extended or adjusted under 35 U.S.C. 154(b) by 309 days.

(21) Appl. No.: 12/030,606

(22) Filed: Apr. 14, 2008

(65) Prior Publication Data

US 2009/0257833 A1 Oct. 15, 2009

(51) Int. Cl.
*B07B 4/00* (2006.01)

(52) U.S. Cl. ..... 241/60; 241/61; 241/98; 241/134

(58) Field of Classification Search ..... 241/60, 241/61, 98, 80, 134, 136, 277, 278.1, 278.2
See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,718,507 | A | 6/1929 | Wenzel et al. |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,193,849 | A | 3/1940 | Whitfield |
| 2,200,713 | A | 5/1940 | Ericson et al. |
| 2,235,542 | A | 3/1941 | Wenzel |
| 2,262,094 | A | 11/1941 | Burt |
| 2,273,962 | A | 2/1942 | Hubbard |
| 2,291,871 | A | 8/1942 | Bokum et al. |

(Continued)

FOREIGN PATENT DOCUMENTS

| | | |
|---|---|---|
| DE | 3238492 | 4/1984 |

(Continued)

OTHER PUBLICATIONS

Hearing Testimony, Case No. 09 CV 263 Division 2, Boulder County District Court, Colorado, Apr. 28, 2009, 11 pages.

(Continued)

*Primary Examiner*—Faye Francis
(74) *Attorney, Agent, or Firm*—James J. Dottavio; Jason S. Fokens

(57) ABSTRACT

A machine is provided for distributing blowing wool from a source of compressed blowing wool. The machine is configured to discharge the blowing wool into distribution hoses. The machine including a shredding chamber having an outlet end. The shredding chamber includes a plurality of shredders configured to condition the blowing wool. A discharge mechanism is mounted at the outlet end of the shredding chamber. The discharge mechanism is configured for distributing the conditioned blowing wool from a discharge mechanism outlet end into an airstream provided by a blower. A choke is positioned between the outlet end of the shredding chamber and the discharge mechanism. The choke is configured to direct heavier clumps of blowing wool to the shredding chamber for further conditioning and configured to allow conditioned blowing wool to enter the discharge mechanism.

11 Claims, 8 Drawing Sheets

U.S. PATENT DOCUMENTS 2,308,197 A 1/1943 Meyer
2,311,773 A 2/1943 Patterson
2,355,358 A 8/1944 Anderson
2,404,678 A 7/1946 Erb
2,437,831 A 3/1948 Moore
2,532,318 A 12/1950 Mackey et al.
2,532,351 A 12/1950 Wedebrock
2,550,354 A 4/1951 Jacobsen
2,618,817 A 11/1952 Slayter
2,721,767 A 10/1955 Kropp
2,754,995 A 7/1956 Switzer
2,794,454 A 6/1957 Moulthrop
2,869,793 A 1/1959 Montgomery
2,938,651 A 5/1960 Specht et al.
2,964,896 A 12/1960 Finocchiaro
2,984,872 A 5/1961 France
2,989,252 A 6/1961 Babb
3,051,398 A 8/1962 Babb
3,076,659 A 2/1963 Kremer
3,175,866 A 3/1965 Nichol
3,201,007 A 8/1965 Transeau
3,231,105 A 1/1966 Easley
3,278,013 A 10/1966 Banks
3,314,732 A 4/1967 Hagan
3,399,931 A 9/1968 Vogt
3,403,942 A 10/1968 Farnworth
3,485,345 A 12/1969 Deasy
3,512,345 A 5/1970 Smith
3,556,355 A 1/1971 Ruiz
3,591,444 A 7/1971 Hoppe et al.
3,703,970 A 11/1972 Benson
3,747,743 A 7/1973 Hoffman, Jr.
3,861,599 A 1/1975 Waggoner
3,869,337 A 3/1975 Hoppe et al.
3,895,745 A 7/1975 Hook
3,952,757 A 4/1976 Huey
3,995,775 A 12/1976 Birkmeier et al.
4,059,205 A 11/1977 Heyl
4,129,338 A 12/1978 Mudgett
4,133,542 A 1/1979 Janian et al.
4,134,508 A 1/1979 Burdett, Jr.
4,155,486 A 5/1979 Brown
4,179,043 A 12/1979 Fischer
4,180,188 A 12/1979 Anouma et al.
4,236,654 A 12/1980 Mello
4,268,205 A 5/1981 Vacca et al.
4,273,296 A 6/1981 Hoshall
4,337,902 A 7/1982 Markham
4,344,580 A 8/1982 Hoshall et al.
4,346,140 A 8/1982 Carlson et al.
4,365,762 A 12/1982 Hoshall
4,381,082 A 4/1983 Elliott et al.
4,411,390 A 10/1983 Woten
4,465,239 A 8/1984 Woten
4,536,121 A 8/1985 Stewart et al.
4,537,333 A 8/1985 Bjerregaard
4,560,307 A 12/1985 Deitesfeld
4,585,239 A 4/1986 Nicholson
4,640,082 A 2/1987 Gill
4,695,501 A 9/1987 Robinson
4,716,712 A 1/1988 Gill
4,784,298 A 11/1988 Heep et al.
4,880,150 A 11/1989 Navin et al.
4,915,265 A 4/1990 Heep et al.
4,919,403 A 4/1990 Bartholomew
4,978,252 A 12/1990 Sperber
5,014,885 A 5/1991 Heep et al.
5,037,014 A 8/1991 Bliss
5,052,288 A 10/1991 Marquez et al.
5,129,554 A 7/1992 Futamura
5,156,499 A 10/1992 Miklich
5,166,236 A 11/1992 Alexander et al.
5,289,982 A 3/1994 Andersen
5,303,672 A 4/1994 Morris
5,323,819 A 6/1994 Shade
5,368,311 A 11/1994 Heyl
5,380,094 A 1/1995 Schmidt et al.
5,392,964 A 2/1995 Stapp et al.
5,405,231 A 4/1995 Kronberg
5,462,238 A 10/1995 Smith et al.
5,472,305 A 12/1995 Ikeda et al.
5,511,730 A 4/1996 Miller et al.
5,601,239 A 2/1997 Smith et al.
5,620,116 A 4/1997 Kluger et al.
5,624,742 A 4/1997 Babbitt et al.
5,639,033 A 6/1997 Miller et al.
5,642,601 A 7/1997 Thompson, Jr. et al.
5,647,696 A 7/1997 Sperber
5,683,810 A 11/1997 Babbitt et al.
5,819,991 A 10/1998 Kohn et al.
5,829,649 A 11/1998 Horton
5,860,232 A 1/1999 Nathenson et al.
5,860,606 A 1/1999 Tiedeman et al.
5,927,558 A 7/1999 Bruce
5,934,809 A 8/1999 Marbler
5,987,833 A 11/1999 Heffelfinger et al.
5,997,220 A 12/1999 Wormser
6,004,023 A 12/1999 Koyanagi et al.
6,036,060 A 3/2000 Munsch et al.
6,070,814 A 6/2000 Deitesfeld
6,074,795 A 6/2000 Watamabe et al.
6,109,488 A 8/2000 Horton
6,161,784 A 12/2000 Horton
6,209,724 B1 4/2001 Miller
6,266,843 B1 7/2001 Donan et al.
6,296,424 B1 10/2001 Ecket et al.
6,312,207 B1 11/2001 Rautiainen
6,503,026 B1 1/2003 Mitchell
6,510,945 B1 1/2003 Allwein et al.
6,648,022 B2 11/2003 Pentz et al.
6,698,458 B1 3/2004 Sollars
6,779,691 B2 8/2004 Cheng
6,783,154 B2 8/2004 Persson et al.
6,796,748 B1 9/2004 Sperber
6,826,991 B1 12/2004 Ramussen
7,284,715 B2 10/2007 Dziesinski et al.
7,354,466 B2 4/2008 Dunning et al.
2001/0036411 A1 11/2001 Walker
2003/0075629 A1 4/2003 Lucas
2003/0192589 A1 10/2003 Jennings
2003/0215165 A1 11/2003 Hogan et al.
2003/0234264 A1 12/2003 Landau
2004/0124262 A1 7/2004 Bowman et al.
2005/0006508 A1 1/2005 Roberts
2005/0242221 A1 11/2005 Rota
2006/0024456 A1 2/2006 O'Leary et al.
2006/0024457 A1 2/2006 O'Leary et al.
2006/0024458 A1 2/2006 O'Leary et al.
2006/0231651 A1 10/2006 Evans et al.
2007/0138211 A1 6/2007 O'Leary et al.
2008/0087751 A1 4/2008 Johnson et al.

FOREIGN PATENT DOCUMENTS

DE 3240126 5/1984
EP 0265751 4/1988
FR 2350450 3/1979
GB 1418882 12/1975
GB 1574027 9/1980
GB 2099776 12/1982
GB 2124194 2/1984
GB 2156303 10/1985
GB 2212471 7/1989
GB 2276147 9/1994

| | | |
|---|---|---|
| JP | 407088985 | 4/1995 |
| NL | 8204888 | 7/1984 |

OTHER PUBLICATIONS

Hearing Testimony, Case No. 09 CV 263 Division 2, Boulder County District Court, Colorado, Apr. 29, 2009, 14 pages.
Hearing Testimony, Case No. 09 CV 263 Division 2, Boulder County District Court, Colorado, Apr. 30, 2009, 35 pages.
Hearing Testimony, Case No. 09 CV 263, Boulder County District Court, Colorado, May 1, 2009, 18 pages.
Hearing Testimony, Case No. 09 CV 263 Division 2, Boulder County District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.
Hearing Testimony, Case No. 09 CV 263 Division K, Boulder County District Court, Colorado, May 7, 2009, 8 pages.
Operator's Manual for Unisul's Mini-Matic Insulation Blowing Maching, Mfg. By UNISUL, Winter Haven, FL, Publication: RTL 100-08/03, CT0000310-CT0000322, 13 pages.
Attic Protector Blow-In Fiber Glass, Johns Manville International-Insulation Group RIG 1718, Denver, CO, www.jm.com, 08/00-REV, CT0000122-CT0000124, 3 page.
The Cyclone Insulation Blowing Machine, Intec, Frederick, CO, info@inteccorp.com, (Exhibit S), 2 pages.
Blow-Matic 8, Abiff Manufacturing Corp., Denver, CO, www.fiberiffic.com, Copyright 2002-2004 Ark-Seal, LLC, CT0000550-CT0000552, 3 pages.
Tiger II, Hoshall Equipmant, Division of Industrial Gaskel, Inc., Oklahoma City, OK, TWX9108313292 Ind Gasket OKC, CT0000555-CT0000556, 2 pages.
The Force/3 Insulation Blower, Intec, Frederick, CO, http://www.inteccorp.com/Force3.htm-4/14/09, OC002923-OC002925, 3 pages.
The Quantum Insulation Blower, Intec, Frederick, CO, http://www.inteccorp.com/Quantum.htm-4/14/09, OC002930-OC002931, 2 pages.
The Wasp Insulation Blower, Intec, Frederick, CO, http://www.intec-corp.com/Wasp.com-5/18/05, CT0000352-CT0000354, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
The Force/1, Intec, Frederick, CO, www.inteccorp.com, D200-0200-00, KL REV 3/04, CT0000008-CT0000055, 50 pages.
Insulation Blowers—Accul 9118, Insulation Machine Corp., Springfield, MA, Copyright 2006, http://accuone.com/accul_9118.html1-4/4/09, CT0000056-CT0000057, 2 pages.
AccuOne 9400, AccuOne Industries, Inc., Copyright 1998, http://www.accu1.com/A9400.htm1-7/13/04, CT0000059, 1 page.
Krendl #325, Krendl Machining Company, Delphos, OH, www.krendlmachine.com, CT0000060, 1 page.
Krendl #450A, Krendl Machining Company, Delphos, OH, http://www.krendlmachine.com/products/450a.asp?PartNo=450A-7/13/04, CT0000067-CT0000068, 2 pages.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.html-4/6/09, CT0000449-CT0000451, 3 pages.
X-Floc Zellofant M95, X-Floc GmbH, Renningen, Germany, Feb. 8, 2009, http://www.x-floc.com/en/machines/zellofant-m95.htm1-4/13/09, CT0000107-CT0000112, 6 pages.
Isoblow Mini, Isocell Vertriebs G.M.B.H., Neumarkt Am Wallersee, Austria, www.isocell.at/home-page/blowing-technology/isoblow-mini.htm1-4/4/09, CT0000436-CT0000438, 3 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
InsulMaxx 1000, Spray Insulation Components, Oklahoma City, OK, http://www.sprayinsulation.com/catalog.asp-1/4/08, CT0000606-CT0000608, 3 pages.
Cocoon-Attic Insulation Blowing Machine, Exhibit II, 2 pages.
U.S. Appl. No. 10/899,909—Advisory Action May 26, 2009.
U.S. Appl. No. 10/899,909—Response to Final May 12, 2009.
U.S. Appl. No. 10/899,909—Final Rejection Mar. 20, 2009.
U.S. Appl. No. 10/899,909—Rejection Sep. 20, 2007.
U.S. Appl. No. 10/899,909—Rejection Apr. 4, 2008.
U.S. Appl. No. 10/899,909—Rejection Sep. 9, 2008.
U.S. Appl. No. 10/899,909—Response Aug. 27, 2007.
U.S. Appl. No. 10/899,909—Response Dec. 20, 2007.
U.S. Appl. No. 10/899,909—Response May 16, 2008.
U.S. Appl. No. 10/899,909—Response Jan. 7, 2009.
U.S. Appl. No. 10/899,909—Restriction Jul. 31, 2007.
U.S. Appl. No. 11/024,093—3 month office action Mar. 2, 2007.
U.S. Appl. No. 11/024,093—3 month office action Jul. 12, 2007.
U.S. Appl. No. 11/024,093—3 month office action Mar. 5, 2009.
U.S. Appl. No. 11/024,093—3 Advisory Action Jan. 11, 2008.
U.S. Appl. No. 11/024,093—Final 3 month Oct. 24, 2007.
U.S. Appl. No. 11/024,093—RCE Jan. 22, 2008.
U.S. Appl. No. 11/024,093—Response Jan. 24, 2007.
U.S. Appl. No. 11/024,093—Response Jun. 4, 2007.
U.S. Appl. No. 11/024,093—Response Oct. 12, 2007.
U.S. Appl. No. 11/024,093—Response Dec. 20, 2007.
U.S. Appl. No. 11/024,093—Response May 28, 2009.
U.S. Appl. No. 11/024,093—Restriction Nov. 24, 2006.
U.S. Appl. No. 11/303,612—3 Month Oct. 15, 2009.
U.S. Appl. No. 11/303,612—Final 3 Month Apr. 30, 2009.
U.S. Appl. No. 11/452,554—3 Month Office Action Apr. 8, 2008.
U.S. Appl. No. 11/452,554—Advisory Action Feb. 6, 2009.
U.S. Appl. No. 11/452,554—Final 3 Month Oct. 15, 2008.
U.S. Appl. No. 11/452,554—Final 3 Month May 5, 2009.
U.S. Appl. No. 11/452,554—RCE Mar. 11, 2009.
U.S. Appl. No. 11/452,554—Response Jun. 4, 2008.
U.S. Appl. No. 11/452,554—Response After Final Jan. 14, 2009.
U.S. Appl. No. 11/581,660—3 month office May 28, 2009.
U.S. Appl. No. 11/581,661—3 Month Apr. 3, 2008.
U.S. Appl. No. 11/581,661—3 Month May 5, 2009.
U.S. Appl. No. 11/581,661—Advisory Action Jan. 27, 2009.
U.S. Appl. No. 11/581,661—Final 3 Month Dec. 3, 2008.
APSCO—Pneumatic Conveying: Dilute Phase Systems, Dense Phase Systems . . . .
Choosing a pneumatic conveying system . . . ; Powder Bulk Engineering; Steve Grant.
Nonaka-Yasuhiro, Japanese Trade-Journal, Article, Characteristics of Functional Chromium Plating and Its Application, , 1999.
PCT Search Report for PCT/US05/26256 dated Nov. 22, 2005.
PCT Search Report for PCT/US05/27124 dated Nov. 22, 2005.
U.S. Appl. No. 11/303,612—Response Jan. 14, 2009.
U.S. Appl. No. 11/581,661—Response Jul. 17, 2008.
U.S. Appl. No. 11/303,612—Response AF Jun. 29, 2009.
U.S. Appl. No. 11/581,661—Response AF Jan. 9, 2009.
U.S. Appl. No. 11/581,661—Response; RCE Feb. 25, 2009.

BLOWING WOOL MACHINE FLOW CONTROL

RELATED APPLICATIONS

This application is related to: Ser. No. 11/581,661 Filed Oct. 16, 2006, Ser. No. 11/581,660 Filed Oct. 16, 2006, Ser. No. 11/581,659 Filed Oct. 16, 2006, Ser. No. 12/002,643 Filed Dec. 18, 2007.

TECHNICAL FIELD

This invention relates to loosefill insulation for insulating buildings. More particularly this invention relates to machines for distributing packaged loosefill insulation.

BACKGROUND OF THE INVENTION

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing wool, is typically compressed in packages for transport from an insulation manufacturing site to a building that is to be insulated. Typically the packages include compressed blowing wool encapsulated in a bag. The bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the package is opened and the blowing wool is allowed to expand.

It would be advantageous if blowing wool machines could be improved to make them easier to use.

SUMMARY OF THE INVENTION

According to this invention there is provided a machine for distributing blowing wool from a source of compressed blowing wool. The machine is configured to discharge the blowing wool into distribution hoses. The machine comprises a shredding chamber having an outlet end. The shredding chamber includes a plurality of shredders configured to condition the blowing wool. A discharge mechanism is mounted at the outlet end of the shredding chamber. The discharge mechanism is configured for distributing the conditioned blowing wool from a discharge mechanism outlet end into an airstream provided by a blower. A choke is positioned between the outlet end of the shredding chamber and the discharge mechanism. The choke is configured to direct heavier clumps of blowing wool to the shredding chamber for further conditioning and configured to allow conditioned blowing wool to enter the discharge mechanism.

According to this invention there is also provided a machine for distributing blowing wool from a source of compressed blowing wool. The machine is configured to discharge blowing wool into distribution hoses. The machine comprises a shredding chamber having an outlet end. The shredding chamber includes a plurality of shredders configured to condition the blowing wool. A discharge mechanism is mounted at the outlet end of the shredding chamber. The discharge mechanism is configured for distributing the conditioned blowing wool from a discharge mechanism outlet end into an airstream provided by a blower. A choke is positioned between the outlet end of the shredding chamber and the discharge mechanism. The choke is configured to direct heavier clumps of blowing wool in a direction substantially tangential to the discharge mechanism and configured to allow conditioned blowing wool to enter the discharge mechanism.

According to this invention there is also provided a machine for distributing blowing wool from a source of compressed blowing wool. The machine is configured to discharge blowing wool into distribution hoses. The machine comprises a shredding chamber having an outlet end. The shredding chamber includes a plurality of shredders configured to condition the blowing wool. A discharge mechanism is mounted at the outlet end of the shredding chamber. The discharge mechanism is configured for distributing the conditioned blowing wool from a discharge mechanism outlet end into an airstream provided by a blower. A choke is positioned between the outlet end of the shredding chamber and the discharge mechanism. The choke is configured to direct heavier clumps of blowing wool to the shredding chamber for further conditioning and configured to allow conditioned blowing wool to enter the discharge mechanism. The choke has a cross-sectional shape providing a desired density of the blowing wool. The machine is configured to be changeable with other chokes having different cross-sectional shapes providing different blowing wool densities.

Various objects and advantages of this invention will become apparent to those skilled in the art from the following detailed description of the invention, when read in light of the accompanying drawings.

DETAILED DESCRIPTION OF THE INVENTION

Figure 1:
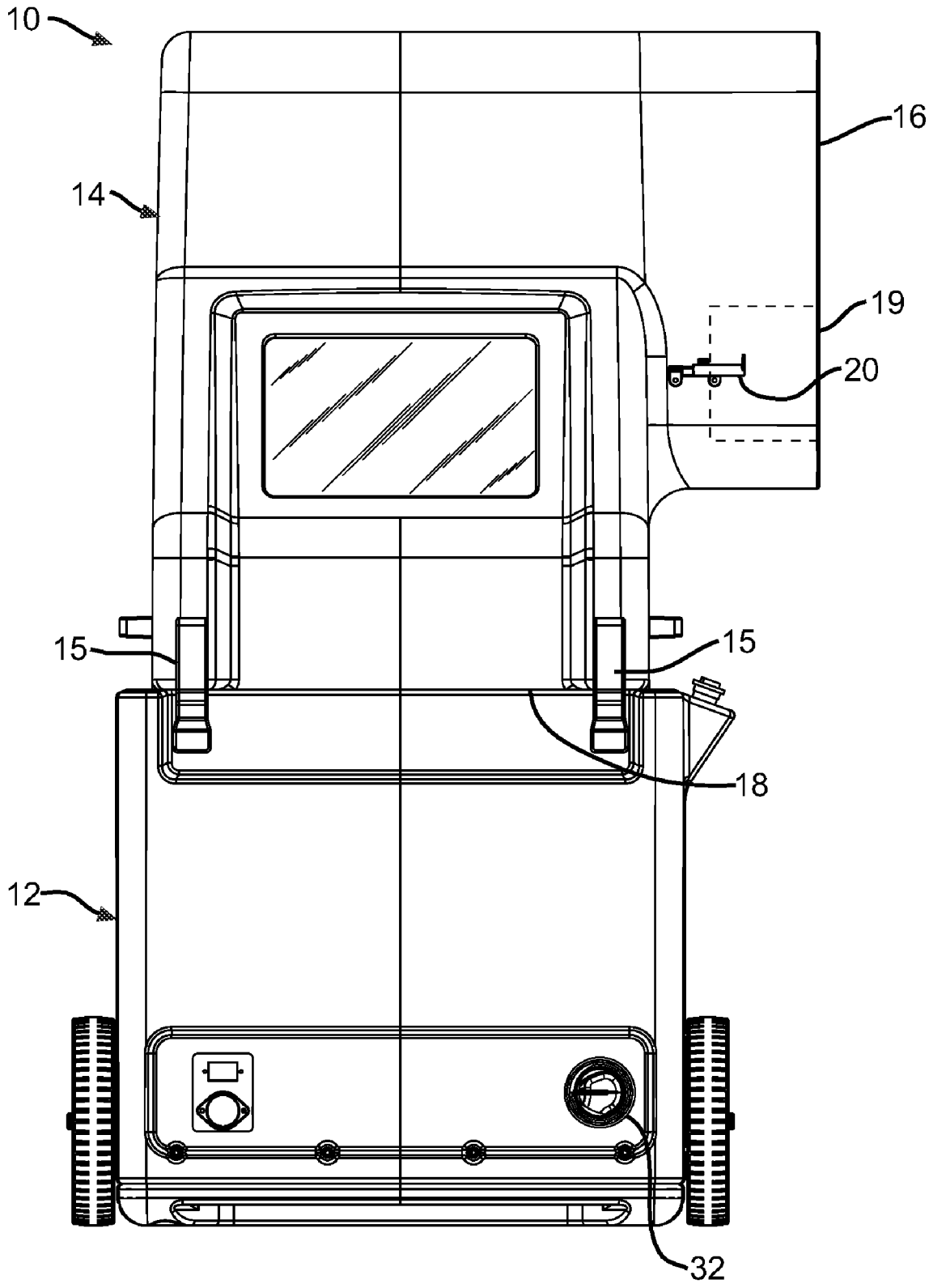
FIG. 1 is a front view in elevation of an insulation blowing wool machine.
Figure 2:
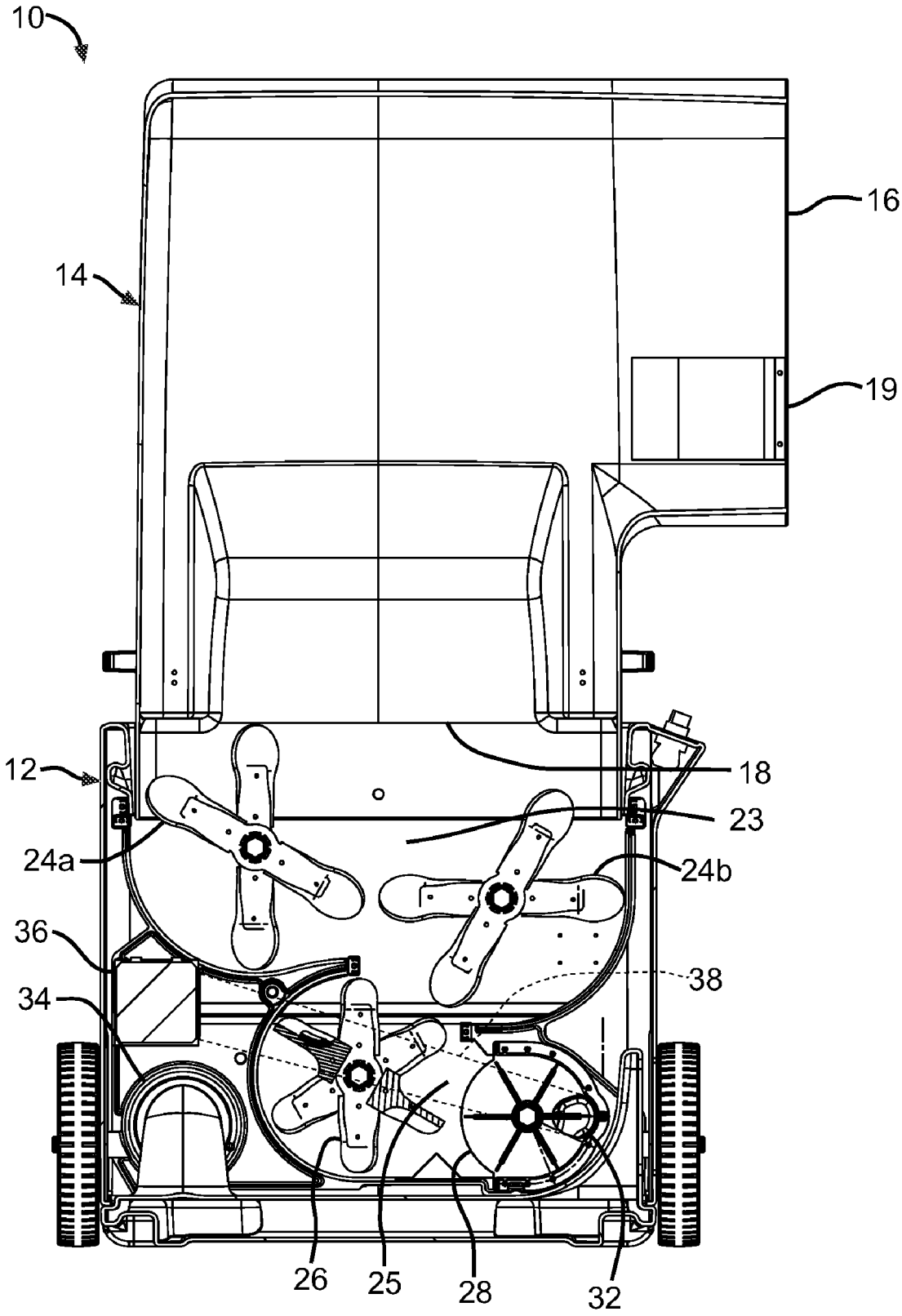
FIG. 2 is a front view in elevation, partially in cross-section, of the insulation blowing wool machine of FIG. 1.
Figure 3:
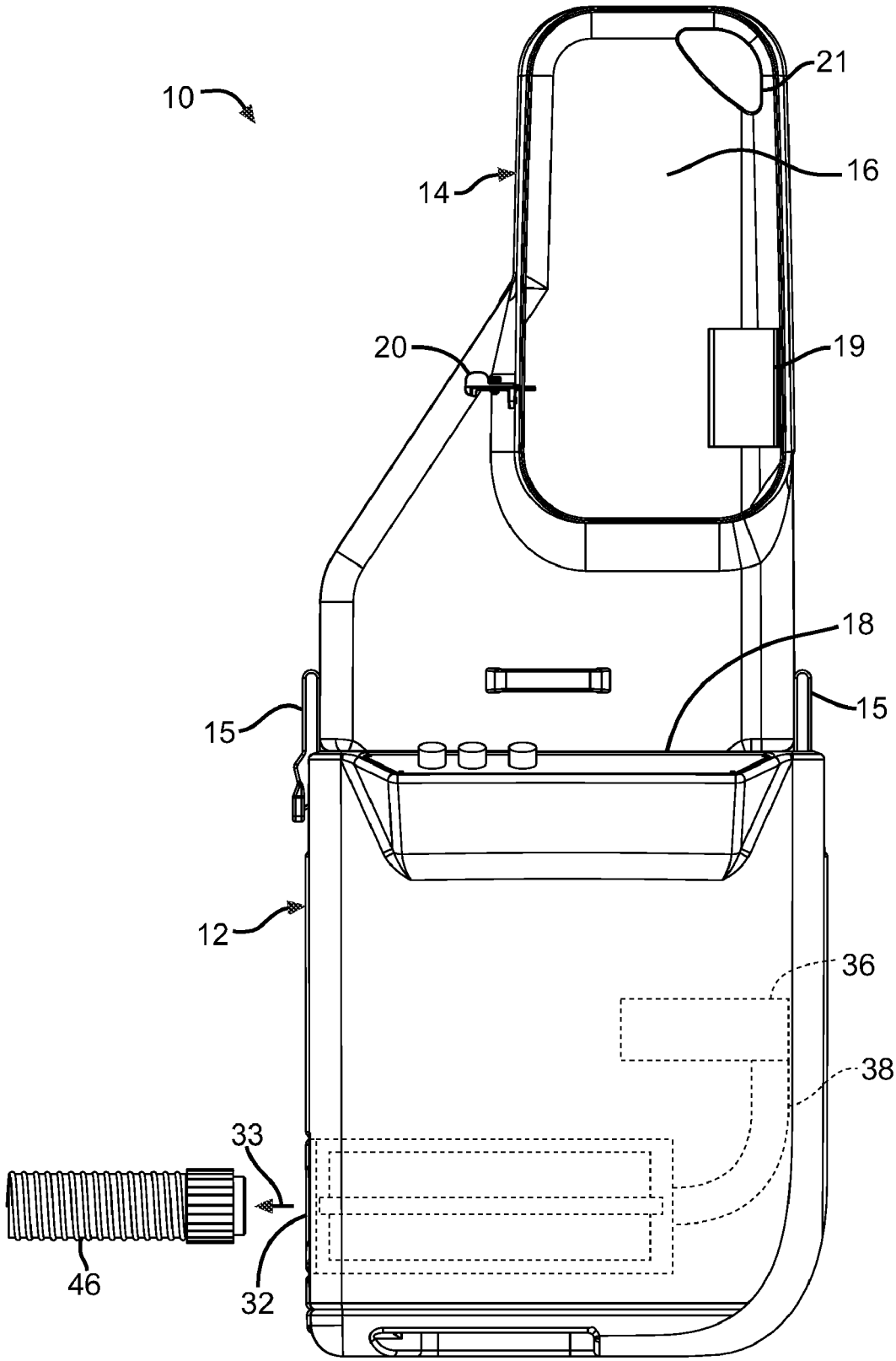
FIG. 3 is a side view in elevation of the insulation blowing wool machine of FIG. 1.

A blowing wool machine 10 for distributing compressed blowing wool is shown in FIGS. 1-3. The blowing wool machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing wool from a source of blowing wool and introduce the blowing wool to the shredding chamber 23 as shown in FIG. 2. Optionally, the chute 14 includes a handle segment 21, as shown in FIG. 3, to facilitate ready movement of the blowing wool machine 10 from one location to another. However, the handle segment 21 is not necessary to the operation of the machine 10.

As further shown in FIGS. 1-3, the chute 14 includes an optional guide assembly 19 mounted at the inlet end 16 of the chute 14. The guide assembly 19 is configured to urge a package of compressed blowing wool against a cutting mechanism 20, shown in FIGS. 1 and 3, as the package moves into the chute 14.

As shown in FIG. 2, the shredding chamber 23 is mounted at the outlet end 18 of the chute 14. In the illustrated embodiment, the shredding chamber 23 includes a plurality of low speed shredders, 24*a* and 24*b*, and an agitator 26. The low speed shredders, 24*a* and 24*b*, shred and pick apart the blowing wool as the blowing wool is discharged from the outlet end 18 of the chute 14 into the lower unit 12. Although the blowing wool machine 10 is shown with a plurality of low speed shredders, 24*a* and 24*b*, any type of separator, such as a clump breaker, beater bar or any other mechanism that shreds and picks apart the blowing wool can be used.

As further shown in FIG. 2, the shredding chamber 23 includes an agitator 26 configured to condition the blowing wool prior to distribution of the blowing wool into an airstream. The term "condition" as used herein, is defined as the shredding of the blowing wool to a desired density prior to distribution into an airstream. In this embodiment as shown in FIG. 2, the agitator 26 is positioned beneath the low speed shredders, 24*a* and 24*b*. Alternatively, the agitator 26 can be disposed in any location relative to the low speed shredders, 24*a* and 24*b*, such as horizontally adjacent to the shredders, 24*a* and 24*b*, sufficient to receive the blowing wool from the low speed shredders, 24*a* and 24*b*. In this embodiment, the agitator 26 is a high speed shredder. Alternatively, any type of shredder can be used, such as a low speed shredder, clump breaker, beater bar or any other mechanism that conditions the blowing wool for distribution into an airstream.

In this embodiment, the low speed shredders, 24*a* and 24*b*, rotate at a lower speed than the agitator 26. The low speed shredders, 24*a* and 24*b*, rotate at a speed of about 40-80 rpm and the agitator 26 rotates at a speed of about 300-500 rpm. In another embodiment, the low speed shredders, 24*a* and 24*b*, can rotate at speeds less than or more than 40-80 rpm and the agitator 26 can rotate at speeds less than or more than 300-500 rpm.

Referring again to FIG. 2, a discharge mechanism 28 is positioned adjacent to the agitator 26 and is configured to distribute the conditioned blowing wool into the airstream. In this embodiment, the conditioned blowing wool is driven through the discharge mechanism 28 and through a machine outlet 32 by an airstream provided by a blower 36 mounted in the lower unit 12. The airstream is indicated by an arrow 33 in FIG. 3. In another embodiment, the airstream 33 can be provided by another method, such as by a vacuum, sufficient to provide an airstream 33 driven through the discharge mechanism 28. In the illustrated embodiment, the blower 36 provides the airstream 33 to the discharge mechanism 28 through a duct 38 as shown in FIG. 2. Alternatively, the airstream 33 can be provided to the discharge mechanism 28 by another structure, such as by a hose or pipe, sufficient to provide the discharge mechanism 28 with the airstream 33.

The shredders, 24*a* and 24*b*, agitator 26, discharge mechanism 28 and the blower 36 are mounted for rotation. They can be driven by any suitable means, such as by a motor 34, or other means sufficient to drive rotary equipment. Alternatively, each of the shredders, 24*a* and 24*b*, agitator 26, discharge mechanism 28 and the blower 36 can be provided with its own motor.

In operation, the chute 14 guides the blowing wool to the shredding chamber 23. The shredding chamber 23 includes the low speed shredders, 24*a* and 24*b*, which shred and pick apart the blowing wool. The shredded blowing wool drops from the low speed shredders, 24*a* and 24*b*, into the agitator 26. The agitator 26 conditions the blowing wool for distribution into the airstream 33 by further shredding the blowing wool. The conditioned blowing wool exits the agitator 26 at an outlet end 25 of the shredding chamber 23 and enters the discharge mechanism 28 for distribution into the airstream 33 provided by the blower 36. The airstream 33, with the conditioned blowing wool, exits the machine 10 at the machine outlet 32 and flows through the distribution hose 46, as shown in FIG. 3, toward the insulation cavity, not shown.

Figure 4:
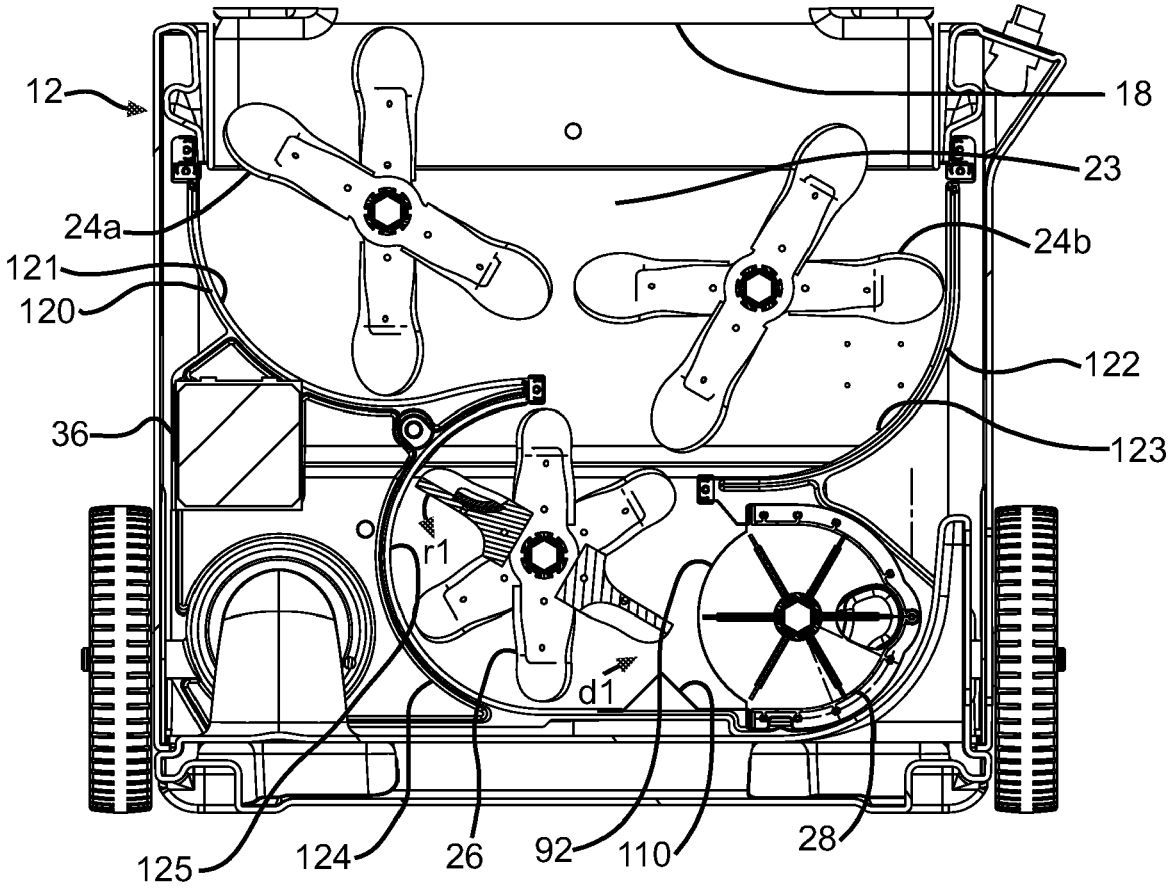
FIG. 4 is a front view, partially in cross section, of the lower unit of the insulation blowing wool machine of FIG. 1.

As previously discussed and as shown in FIG. 4, the discharge mechanism 28 is configured to distribute the conditioned blowing wool into the airstream 33. In this embodiment, the discharge mechanism 28 is a rotary valve. Alternatively the discharge mechanism 28 can be any other mechanism including staging hoppers, metering devices, rotary feeders, sufficient to distribute the conditioned blowing wool into the airstream 33.

In the embodiment shown in FIG. 4, the shredding chamber 23 includes an first upper guide shroud 120, a second upper guide shroud 122 and an agitator guide shroud 124. The first upper shroud 120 is positioned partially around the low speed shredder 24*a* and extends to form an arc of approximately 90°. The first upper shroud 120 has a first shroud inner surface 121. The first upper shroud 120 is configured to allow the low speed shredder 24*a* to seal against the first shroud inner surface 121 and thereby direct the blowing wool in a downstream direction as the low speed shredder 24*a* rotates. In a similar manner as the first upper guide shroud 120, the second upper guide shroud 122 is positioned partially around another low speed shredder 24*b* and extends to form an arc of approximately 90°. The second upper guide shroud 122 has an second shroud inner surface 123. The second guide shroud 122 is configured to allow the low speed shredder 24*b* to seal against the second shroud inner surface 123 and thereby direct the blowing wool in a downstream direction as the low speed shredder 24*b* rotates. While FIG. 4 illustrates the first and second upper guide shrouds, 120 and 122, form arcs of approximately 90°, it should be appreciated that the upper shrouds, 120 and 122, can form arcs of other sizes sufficient to direct the blowing wool in a downstream direction. While the embodiment shown in FIG. 4 illustrates two upper guide shrouds, it should be understood that any number of upper guide shrouds, sufficient to direct the blowing wool in a downstream direction can be used.

In a manner similar to the first and second upper guide shrouds, 120 and 122, the agitator guide shroud 124 is positioned partially around the agitator 26 and extends to form an approximate semi-circle. The agitator guide shroud 124 has an agitator guide shroud inner surface 125. The agitator guide shroud 124 is configured to allow the agitator 26 to seal against the agitator guide shroud inner surface 125 and thereby direct the blowing wool in a downstream direction as the agitator 26 rotates. While FIG. 4 illustrates the agitator guide shroud 124 forms an arc of approximately 180°, it should be appreciated that the agitator guide shroud 124 can form an arc of other sizes sufficient to direct the blowing wool in a downstream direction. While the embodiment shown in FIG. 4 illustrates one agitator guide shroud 124, it should be understood that any number of agitator guide shrouds, sufficient to direct the blowing wool in a downstream direction can be used.

In the illustrated embodiment shown in FIG. 4, the first and second upper guide shrouds, 120 and 122, and the agitator guide shroud 124 are made from formed aluminum sheet. Alternatively, the first and second upper guide shrouds, 120 and 122, and the agitator guide shroud 124 can be made from other processes and of other materials, such as for example plastic or steel, sufficient to seal against rotating shredders and agitators and direct the blowing wool in a downstream direction.

In the illustrated embodiment, the first and second shroud inner surfaces, 121 and 123, and the agitator shroud inner surface 125 have a smooth finish. The smooth finish is configured to allow the blowing wool to easily pass over the inner surfaces, 121, 123 and 125. In the illustrated embodiment, the first and second shroud inner surfaces, 121 and 123, and the agitator shroud inner surface 125 have the smooth unfinished surface of the aluminum sheet. Alternatively, the first and second shroud inner surfaces, 121 and 123, and the agitator shroud inner surface 125 can have a finished surface or the inner surfaces can be covered or plated with other materials. Examples of a finished surface include machined or polished surfaces. Examples of optional embodiments where the inner surfaces, 121, 123 and 125, are covered or plated with other materials include a coating of a low friction material, such as for example, Teflon® or Teflon® impregnated high density plastic (hdpe).

The first and second upper guide shrouds, 120 and 122, and the agitator guide shroud 124 are attached to the lower unit 12 by fasteners (not shown). In the illustrated embodiment, the fasteners are bolts. Alternatively, the first and second upper guide shrouds, 120 and 122, and the agitator guide shroud 124 can be attached to the lower unit by other mechanical fasteners, such as clips or clamps, or by other fastening methods including sonic welding or adhesive.

Referring again to FIG. 4, the discharge mechanism 28 has a side inlet 92 and a choke 110. The side inlet 92 is configured to receive the conditioned blowing wool as it is fed from the agitator 26. In this embodiment, the agitator 26 is positioned to be adjacent to the side inlet 92 of the discharge mechanism 28. In another embodiment, a low speed shredder 24, or a plurality of shredders 24 or agitators 26, or other shredding mechanisms can be adjacent to the side inlet 92 of the discharge mechanism or in other suitable positions. As will be described in detail below, the choke 110 is configured to redirect heavier clumps of blowing wool past the side inlet 92 of the discharge mechanism 28 and back to the low speed shredders, 24*a* and 24*b*, for further conditioning.

Figure 5A:
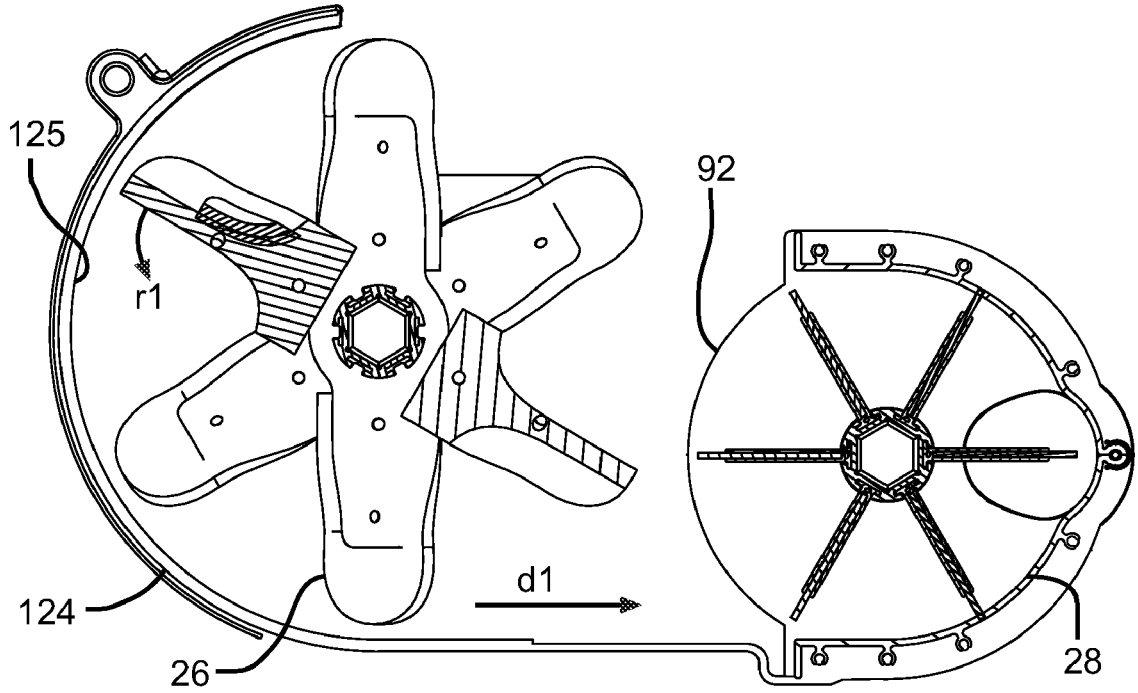
FIG. 5*a* is a front view, partially in cross section, of a portion of the lower unit of the insulation blowing wool machine of FIG. 1 shown without the choke.

Referring now to FIG. 5*a*, the choke 110 has been removed from the blowing wool machine 10. In this embodiment, all of the blowing wool, including conditioned and unconditioned blowing wool having heavier clumps, is fed in a substantially horizontal direction d1 and enters the side inlet 92 of the discharge mechanism. While the embodiment shown in FIG. 5*a* is illustrative of a blowing wool machine without a choke, it should be understood that the embodiment shown in FIG. 5 is illustrative of an embodiment of a blowing wool machine having a choke with a substantially flat cross-sectional shape (not shown).

Figure 5B:
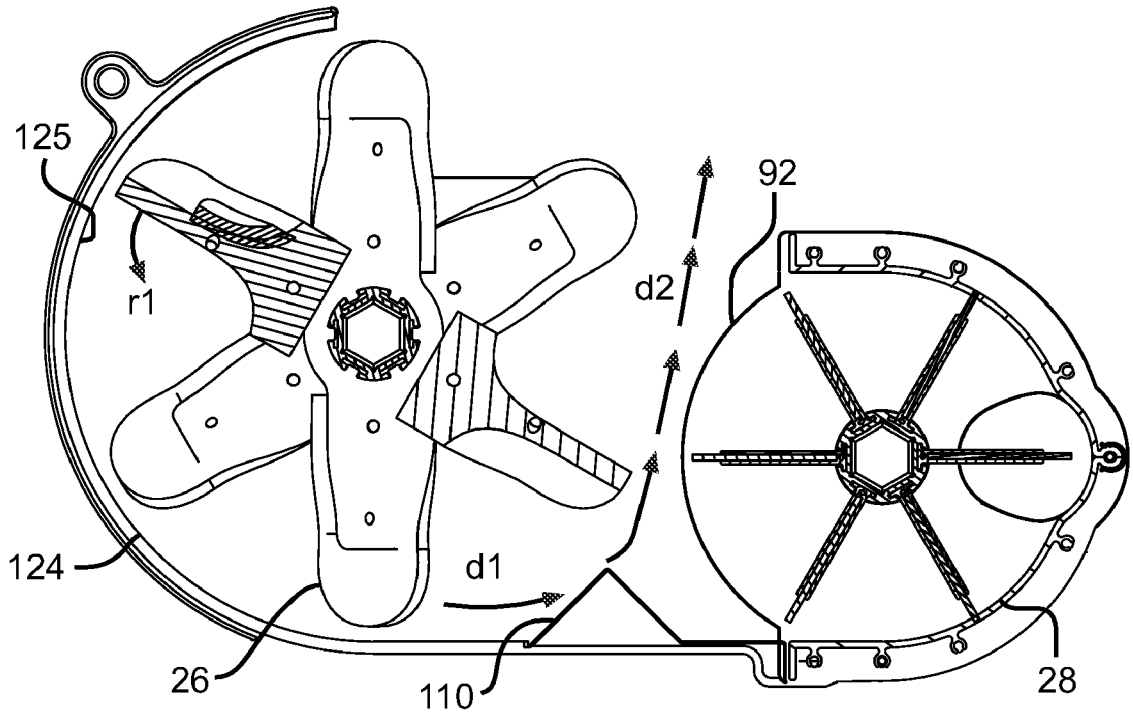
FIG. 5*b* is a front view, partially in cross section, of a portion of the lower unit of the insulation blowing wool machine of FIG. 1 shown with the choke.

In the embodiment shown in FIG. 5*b*, the choke 110 has been installed in the blowing wool machine 10 between the agitator 26 and the discharge mechanism 28. The choke 110 is configured to simultaneously partially obstruct the side inlet 92 of the discharge mechanism 28 and to redirect the blowing wool traveling from the agitator 26 in direction d1 to substantially upward direction d2. In direction d2, the conditioned blowing wool migrates into the side inlet 92 of the discharge mechanism 28 while the heavier clumps of blowing wool are prevented from entering the side inlet 92 of the discharge mechanism 28. The heavier clumps of blowing wool are redirected past the side inlet 92 of the discharge mechanism 28 to the low speed shredders 24*a* and 24*b* for recycling and further conditioning. Referring again to the embodiment shown in FIG. 5*b*, the generally upward direction d2 is substantially tangential to the side inlet 92 of the discharge mechanism 28. Alternatively, the generally upward direction d2 can be in other directions.

Summarizing the operation of the blowing wool machine 10 as shown in FIGS. 4 and 5*b*, the shredded blowing wool exits the low speed shredders 24*a* and 24*b* and drops into the agitator 26 for conditioning. The agitator 26 rotates in a counter-clockwise direction r1 thereby forming finely shredded conditioned blowing wool and heavier clumps of blowing wool. The agitator 26 forces the shredded blowing wool in direction d1 toward the choke 110. Upon impact with the choke 110, the shredded blowing wool is redirected to substantially upward direction d2. In direction d2, the conditioned blowing wool migrates into the side inlet 92 of the discharge mechanism 28 while the heavier clumps of blowing wool are prevented from entering the side inlet 92 of the discharge mechanism 28. The heavier clumps of blowing wool are redirected past the side inlet 92 of the discharge mechanism 28 to the low speed shredders 24*a* and 24*b* for recycling and further conditioning.

The cross-sectional shape and height of the choke 110 can be configured to control the conditioning properties of the blowing wool entering the side inlet of the discharge mechanism. As one example, a choke 110 having a larger height results in conditioned wool having a lighter density. In another embodiment, a choke 110 having a lower height or no height results in conditioned wool having a heavier density. Additionally, the shape and height of the choke 110 can be configured to control the flow rate of the conditioned blowing wool entering the side inlet 92 of the discharge mechanism 28. In one embodiment illustrated in FIGS. 4, 5B and 6, the choke 110 has a triangular cross-sectional shape.

Figure 6:
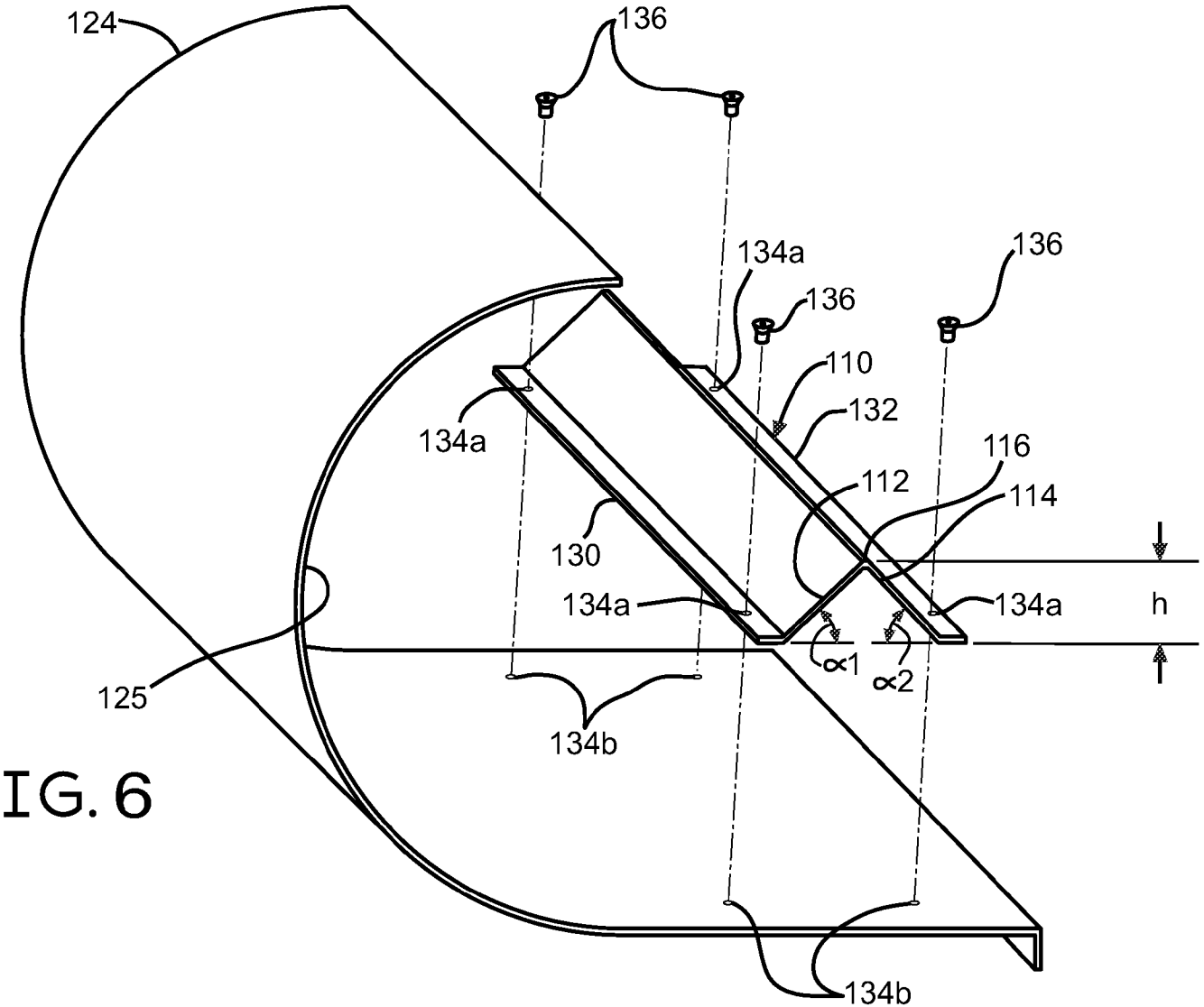
FIG. 6 is a perspective exploded view of a choke and lower guide shroud of the insulation blowing wool machine of FIG. 1.

As shown in FIG. 6, the choke 110 has converging choke sides 112 and 114. One end of each choke side, 112 and 114, converges to form a choke peak 116. The opposite ends of each choke side, 112 and 114, are connected to mounting members 130 and 132. The mounting members, 130 and 132, have apertures 134*a* corresponding to agitator guide shroud apertures 134*b*. In the illustrated embodiment, the choke 110 is mounted to the agitator guide shroud 124 by choke fasteners 136 passing through the apertures 134*a* and connecting to apertures 134*b*. In the illustrated embodiment, the fasteners 136 are screws. The mounting of the choke 110 to the agitator guide shroud 124 is configured such that the choke 110 can be readily installed and removed by the machine user without the use of special tools. The use of a readily removable choke 110 allows the machine user the flexibility to use various configurations of the choke 110 to achieve desired conditioning properties, such as lighter or heavier wool densities. While the embodiment shown in FIG. 6 illustrated the use of fasteners 136 for attaching the choke 110 to the agitator guide shroud 124, it should be appreciated that the choke can be attached to the agitator guide shroud 124 by other mechanisms, such as for example clips, bolts or clamps, sufficient to allow the choke 110 to be readily installed and removed by the machine user.

Referring again to FIG. 6, the choke 110 has a height h. As described above, the height h and the shape of the choke 110 control the conditioning properties and flow rate of the conditioned blowing wool entering the side inlet 92 of the discharge mechanism 28. In the illustrated embodiment, the height h of the choke 110 is approximately 1.1875 inches resulting in a density of approximately 0.557 pcf and a flow rate of approximately 7.2 lbs/min of conditioned blowing wool entering the side inlet 92 of the discharge mechanism 28. Alternatively, the height h of the choke 110 can be more or less than 1.1875 inches resulting in a density of more or less than 0.557 pcf and flow rate of more or less than 7.2 lbs/min. As mentioned above, it is within the scope of this invention that the height of the choke can be 0 inches resulting in a substantially flat choke.

As shown in FIG. 6, the choke sides, 112 and 114, form angles $\alpha$1 and $\alpha$2 with the agitator guide shroud 124. In the illustrated embodiment, the angles $\alpha$1 and $\alpha$2 are each 45° thereby forming the cross-sectional shape of an isosceles triangle. Alternatively, the angles $\alpha$1 and $\alpha$2 can be more or less than 45°. In yet another embodiment, the angles $\alpha$1 and $\alpha$2 can be different angles.

Figure 7:
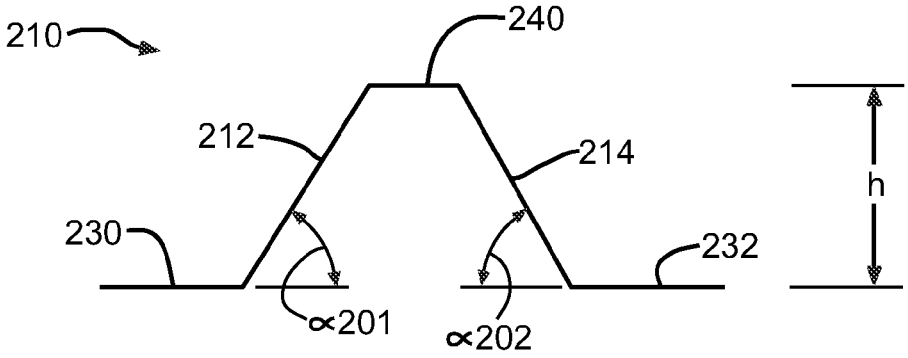
FIG. 7 is a side view in elevation of a second embodiment of the choke of the insulation blowing wool machine of FIG. 1.

As shown in FIGS. 7-11, the choke can have other cross-sectional shapes sufficient to control the density and flow rate of the conditioned blowing wool entering the side inlet 92 of the discharge mechanism 28 and to direct heavier clumps of blowing wool past the side inlet 92 of the discharge mechanism 28 to the low speed shredders 24*a* and 24*b* for recycling. One example of an alternative cross-sectional shape is shown in FIG. 7. The choke 210 includes converging choke sides 212 and 214, mounting members 230 and 232, angles $\alpha$201 and $\alpha$202 and height h. The converging choke sides, 212 and 214, form top surface 240. In the illustrated embodiment, the angles $\alpha$201 and $\alpha$202 are each approximately 60°. Alternatively, the angles $\alpha$201 and $\alpha$202 can be more or less than 60°. In yet another embodiment, the angles $\alpha$201 and $\alpha$202 can be different angles. In the illustrated embodiment, the height h of the choke 210 is approximately 1.1875 inches. Alternatively, the height h of the choke 210 can be more or less than 1.1875 inches.

Figure 8:
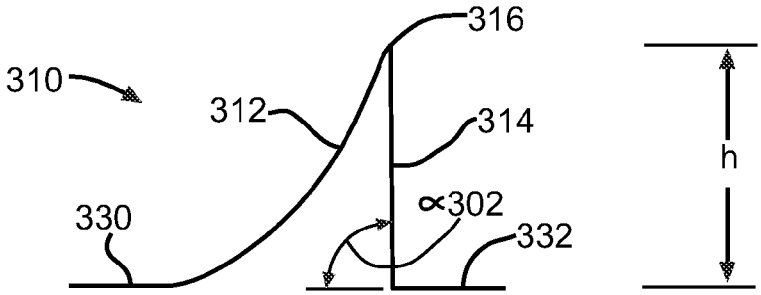
FIG. 8 is a side view in elevation of a third embodiment of the choke of the insulation blowing wool machine of FIG. 1.

Another example of an alternate cross-sectional choke shape is shown in FIG. 8. The choke 310 includes arcuate choke side 312 converging with choke side 314 and mounting members 330 and 332. Angle $\alpha$302 is formed between the choke side 314 and the agitator guide shroud (not shown). In the illustrated embodiment, the angle $\alpha$302 is approximately 90°. Alternatively, the angle $\alpha$302 can be more or less than 90°. Peak 316 is formed by the intersection of arcuate choke side 312 and choke side 314. The choke has a height h. As described above, the height h of the choke 310 can be any suitable dimension.

Figure 9:
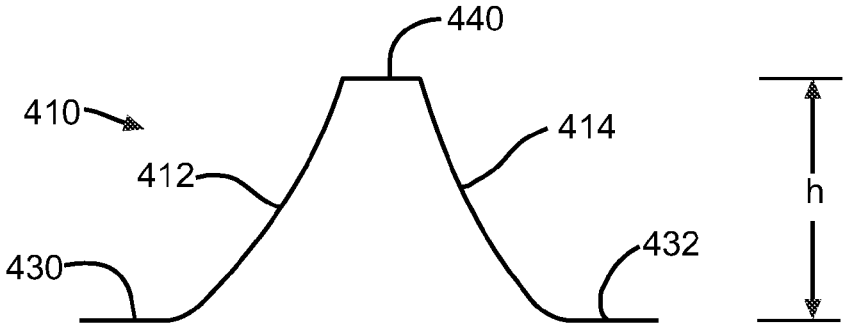
FIG. 9 is a side view in elevation of a fourth embodiment of the choke of the insulation blowing wool machine of FIG. 1.

The alternate cross-sectional choke shape 410 shown in FIG. 9 includes converging arcuate choke sides 412 and 414, mounting members 430 and 432, top surface 440 and height h. While the converging arcuate choke sides, 412 and 414, form top surface 440, alternatively the converging choke sides 412 and 414 can intersect to form a peak (not shown).

Figure 10:
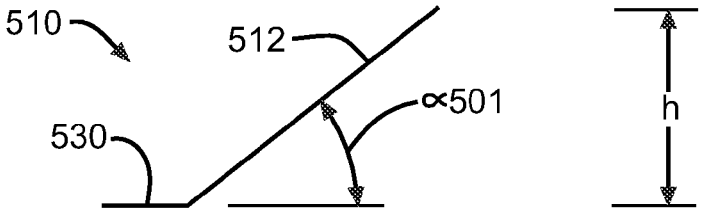
FIG. 10 is a side view in elevation of a fifth embodiment of the choke of the insulation blowing wool machine of FIG. 1.

Another example of an alternate cross-sectional choke shape is shown in FIG. 10. The choke 510 includes choke side 512 connected to mounting member 530. The choke side 512 forms angle $\alpha$501 with the agitator guide shroud (not shown). In the illustrated embodiment, the angle $\alpha$501 is approximately 45°. Alternatively, the angle $\alpha$501 can be more or less than 45°. In the illustrated embodiment, the height h of the choke 510 is approximately 1.1875 inches. Alternatively, the height h of the choke 510 can be more or less than 1.1875 inches. In another embodiment, the choke 510 can have a top surface (not shown).

Figure 11:
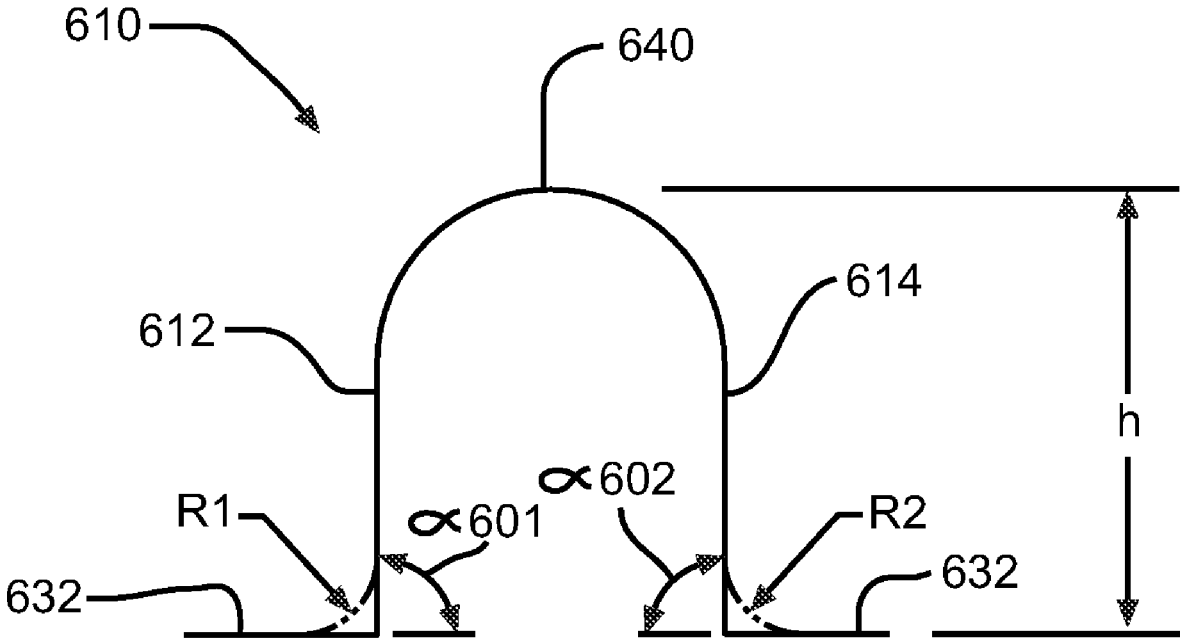
FIG. 11 is a side view in elevation of a sixth embodiment of the choke of the insulation blowing wool machine of FIG. 1.

Another example of an alternate cross-sectional choke shape is shown in FIG. 11. The choke 610 includes choke sides 612 and 614. The choke sides 612 and 614 are connected at one end to mounting members 630 and 632. In the illustrated embodiment, the choke sides, 612 and 614, and the mounting members, 630 and 632, are shown as intersecting at approximate right angles. In another embodiment, the choke sides, 612 and 614, and the mounting members, 630 and 632, can have a radiused intersections, R1 and R2. The radiused intersections, R1 and R2, can be any suitable dimension. Angles $\alpha$601 and $\alpha$602 are formed between the choke sides, 612 and 614, and the agitator guide shroud (not shown). In the illustrated embodiment, the angles $\alpha$601 and $\alpha$602 are approximately 90°. Alternatively, the angle $\alpha$601 and $\alpha$602 can be more or less than 90°. Top 640 is formed by a radiused segment between the choke sides 612 and 614. The radiused segment can be any suitable radial dimension. The choke 610 has a height h. As described above, the height h of the choke 610 can be any suitable dimension.

The principle and mode of operation of this blowing wool machine have been described in its preferred embodiments. However, it should be noted that the blowing wool machine may be practiced otherwise than as specifically illustrated and described without departing from its scope.

What is claimed is:

1. A machine for distributing blowing wool from a source of compressed blowing wool, the machine being configured to discharge the blowing wool into distribution hoses, the machine comprising:

a shredding chamber having an outlet end, the shredding chamber including a plurality of shredders configured to condition the blowing wool;

a discharge mechanism mounted at the outlet end of the shredding chamber, the discharge mechanism configured for distributing the conditioned blowing wool from a discharge mechanism outlet end into an airstream provided by a blower; and a choke positioned between the outlet end of the shredding chamber and the discharge mechanism, the choke configured to direct heavier clumps of blowing wool to the shredding chamber for further conditioning and configured to allow conditioned blowing wool to enter the discharge mechanism.

2. The machine of claim 1 in which the discharge mechanism has a side inlet, wherein the choke is positioned between the outlet end of the shredding chamber and the side inlet of the discharge mechanism.

3. The machine of claim 2 in which the choke partially obstructs the side inlet of the discharge mechanism.

4. The machine of claim 2 in which the choke directs heavier clumps of blowing wool upward past the side inlet of the discharge mechanism.

5. The machine of claim 1 in which the choke has a choke height, wherein varying the choke height results in varying the density of the conditioned blowing wool.

6. The machine of claim 5 in which the choke height is approximately 1.1875 inches.

7. The machine of claim 6 in which the choke height results in a density of the conditioned blowing wool of 0.557 pcf and a flow rate of approximately 7.2 lbs/min.

8. The machine of claim 1 in which the choke has a triangular cross-sectional shape.

9. The machine of claim 8 in which the triangular cross-sectional shape is an isosceles triangle.

10. The machine of claim 1 in which the choke has converging sides, wherein the converging sides form as top surface.

11. The machine of claim 10 in which the converging sides have an arcuate cross-sectional shape.

* * * * *